US009637842B2

(12) United States Patent
Xie et al.

(10) Patent No.: US 9,637,842 B2
(45) Date of Patent: May 2, 2017

(54) SPINNING METHOD AND DEVICE OF DRAFTING WITH INITIAL TWIST

(71) Applicant: JIANGNAN UNIVERSITY, Jiangsu (CN)

(72) Inventors: Chunping Xie, Jiangsu (CN); Weidong Gao, Jiangsu (CN); Xinjin Liu, Jiangsu (CN); Xuzhong Su, Jiangsu (CN); Bojun Xu, Jiangsu (CN); Hong Zhang, Jiangsu (CN)

(73) Assignee: JIANGNAN UNIVERSITY, Wuxi, Jiangsu (CN)

( * ) Notice: Subject to any disclaimer, the term of this patent is extended or adjusted under 35 U.S.C. 154(b) by 192 days.

(21) Appl. No.: 14/596,354

(22) Filed: Jan. 14, 2015

(65) Prior Publication Data

US 2015/0252496 A1 Sep. 10, 2015

(30) Foreign Application Priority Data

Mar. 6, 2014 (CN) ..... 2014 1 0081064

(51) Int. Cl.
*D01H 5/72* (2006.01)
*D01H 1/02* (2006.01)

(52) U.S. Cl.
CPC ..... *D01H 5/72* (2013.01); *D01H 1/025* (2013.01)

(58) Field of Classification Search
CPC ..... D01H 1/025; D01H 5/72
See application file for complete search history.

(56) References Cited

U.S. PATENT DOCUMENTS 4,953,349 A * 9/1990 Fehrer ..... D01H 1/025 19/236
5,617,714 A * 4/1997 Fehrer ..... D01H 5/22 57/315
5,724,800 A * 3/1998 Lucca ..... D01H 5/72 57/200
5,996,181 A * 12/1999 Fuchs ..... D01H 5/72 19/150
6,131,383 A 10/2000 Dinkelmann et al.
6,263,654 B1 * 7/2001 Stahlecker ..... D01H 5/86 19/246
6,318,060 B1 * 11/2001 Dinkelmann ..... D01H 1/025 19/244

(Continued)

FOREIGN PATENT DOCUMENTS

CN 1048298 C 1/2000
CN 2677396 Y 2/2005

*Primary Examiner* — Shaun R Hurley
(74) *Attorney, Agent, or Firm* — Ladas & Parry LLP

(57) ABSTRACT

The present invention relates to a method and spinning device for drafting single yarns. The method comprises drafting fiber strands into twistless fiber strands, bringing a primary twist action upon fiber strands in the vortex twist zone, integrating and compressing fiber strands on the suction member to form column fiber strands, outputting column fiber strands and twisting them into spun yarns. The spinning device comprises a drafting mechanism with suction members, wherein the front drafting pair consists of a front rubber roller, a block rubber roller, and a suction member, an air guide member is installed on the suction member, and the block rubber roller, air guide member, and the suction member jointly form a vortex twist zone which fiber strands can pass through.

9 Claims, 5 Drawing Sheets

(56) References Cited

U.S. PATENT DOCUMENTS

| | | | | |
|---|---|---|---|---|
| 6,332,244 | B1 * | 12/2001 | Camozzi | D01H 1/22 19/150 |
| 2001/0009052 | A1 * | 7/2001 | Stahlecker | D01H 5/72 19/246 |
| 2001/0037639 | A1 * | 11/2001 | Stahlecker | D01H 1/22 57/315 |
| 2002/0134068 | A1 * | 9/2002 | Gnos | D01H 5/74 57/315 |
| 2002/0157217 | A1 * | 10/2002 | Camozzi | D01H 5/66 19/246 |
| 2002/0157218 | A1 * | 10/2002 | Camozzi | D01H 5/72 19/246 |
| 2013/0239369 | A1 * | 9/2013 | Schneider | D01H 5/72 19/246 |

* cited by examiner

SPINNING METHOD AND DEVICE OF DRAFTING WITH INITIAL TWIST

FIELD OF THE INVENTION

The present invention relates to a method for drafting single yarns and providing primary twist on a drafting mechanism, and also relates to a spinning device which can put the method into effect. The present invention belongs to the technical field of ring spinning.

BACKGROUND OF THE INVENTION

To the knowledge of the applicant, currently, time-honored ring spinning is still the most leading method for producing spun yarns. The method is used to draft fed fiber strands with a twist and twist them into desired spun yarns. However, the following major problems exist in ring spinning: Owing to the existence of a triangle zone, on the one hand, the head and tail of fibers are not easily wrapped into yarns to form hairiness, and on the other hand, edge fibers and central fibers are not easily broken at the same time because of a great tension difference between them so that the strength of individual fibers cannot be fully utilized and the strength of single yarns is reduced.

To solve these problems, researchers in the textile industry have made many researches on the triangle zone in ring spinning and have achieved a series of fruitful achievements in theoretical researches and engineering practice. In the searches on optimization and improvement, especially reduction or even elimination of the triangle zone in ring spinning, the airflow integration method has become an important technique to integrate drafted strands compactly.

For example, a Chinese invention patent (Patent No.: 95108623.5, authorized publication number: CN 1048298 C) discloses a spinning method and a fine spinning frame adopting a suction roller with a guider on the drafting mechanism. An air suction roller is equipped in the patent and a radial air suction zone is equipped on the exterior circumference of the air suction roller so that air flowing into the air suction roller produces a condensation action to condense crafted twistless fiber bands into compact fiber strands. Moreover, a Chinese utility model (Patent No.: 032056083, authorized publication number: CN2677396 Y) discloses a spun yarn integration spinning device adopting a short suction tube and a technique similar to that in Patent No. 95108623.5 is also adopted in Patent No. 03205608.7.

All prior airflow integration techniques adopt a negative-pressure airflow to condense drafted twistless fiber strands in the area between the output of the roller and twist so as to reduce the triangle zone, improve the quality of resultant yarns, and especially reduce the hairiness of resultant yarns. However, the action of such direct condensation upon integration and compression of fiber strands is limited after all. In addition, fiber strands cannot obtain an original twist before being twisted, which cannot help to improve the strength of final resultant yarns.

SUMMARY OF THE INVENTION

To overcome the technical problems in prior arts, the prevent invention is intended to provide a method for drafting single yarns, which can primarily twist drafted twistless fiber strands so that they have an original twist and obtain a stronger integration and compression effect to improve the quality of resultant yarns. The present invention is also intended to provide a spinning device which can put the method into effect.

To solve the technical problems, the following technical solution is adopted for the present invention:

A method for drafting single yarns, comprising the following steps:

step 1. feed fiber strands with a twist into the drafting mechanism to draft and obtain twistless fiber strands at the output holding jaw of the drafting mechanism, step 2. move said fiber strands to the vortex twist zone which is located between the output holding jaw and the block jaw of the drafting mechanism and draws in air from the outside to form an air eddy, which brings a primary twist action upon fiber strands so that fiber strands have an original twist, along the axis of fiber strands, and integrate and compress fiber strands on the suction member under the suction action of the suction member under the vortex twist zone to form column fiber strands, step 3. output said column fiber strands from the block jaw of the drafting mechanism and twist them into spun yarns, wherein, the diameter of column fiber strands obtained in step 2 is at most four times that of spun yarns obtained in step 3.

The improved solution for the method in the present invention is as follows:

Preferably, said output holding jaw consists of the front rubber roller and the suction member, said block jaw consists of the block rubber roller and the suction member, an air guide member located between the front rubber roller and the block rubber roller is installed above said suction member, and said vortex twist zone is an area formed by the front rubber roller, block rubber roller, air guide member, and the suction member to allow fiber strands to pass through.

Preferably, said suction member is a cylindrical member equipped with a group of first arc grooves in the side wall, said first arc grooves are parallel to each other and are bent along the circumference of the suction member, the hollow area of said suction member is connected to an external air extractor, said air guide member has a substrate laid along the axis of the suction member, said substrate is equipped with a group of parallel second arc grooves, said second arc grooves are bent along the axis of the suction member, and the bending directions of said first and second arc grooves are vertical to each other.

Preferably, in step 2, outside air first goes along the second arc grooves of the air guide member into the vortex twist zone under the suction action of the external air extractor, then along the first arc grooves of the suction member into the hollow area of the suction member, and are finally extracted by the external air extractor so that an air eddy rotating round the axis of fiber strands is formed in the vortex twist zone.

The present invention also provides:

A spinning device for drafting single yarns, comprising a drafting mechanism with several drafting pairs further comprising a front drafting pair at least, which is characterized in that said drafting mechanism has a cylindrical suction member, said front drafting pair consists of a front rubber roller, a block rubber roller, and a suction member, said front rubber roller and the suction member form the output holding jaw and said block rubber roller and the suction member form the block jaw, an air guide member located between the front rubber roller and the block rusher roller is installed above said suction member, a first suction channel is equipped in the side wall of said suction member, a second suction channel is equipped in said air guide member, and said front rubber roller, block rubber roller, air guide member, and suction member jointly form a vortex twist zone which fiber strands can pass through.

The improved solution for the device in the present invention is as follows:

Preferably, said first suction channel is a group of first arc grooves which are parallel to each other and are bent along the circumference of the suction member, the hollow area of said suction member is connected to an external air extractor, said second suction channel is a group of second arc grooves which are parallel to each other and are bent along the axis of the suction member, and the bending directions of said first and second arc grooves are vertical to each other.

Preferably, said air guide member has a substrate laid along the axis of the suction member and said second arc grooves are set in the substrate.

Preferably, the substrate of said air guide member has a curvature to match the suction member.

Preferably, said drafting pairs further comprise a middle drafting pair and a rear drafting pair, said middle drafting pair consists of a middle rubber roller and a middle roller, and said rear drafting pair consists of a rear rubber roller and a rear roller.

Compared with prior art, the present invention can primarily twist drafted twistless fiber strands so that fiber strands have an original twist to obtain a stronger integration and compression effect, which helps to improve the quality of resultant yarns and in particular reduce hairiness of yarns and improve the strength of resultant yarns.

DETAILED DESCRIPTION OF THE INVENTION

Figure 1:
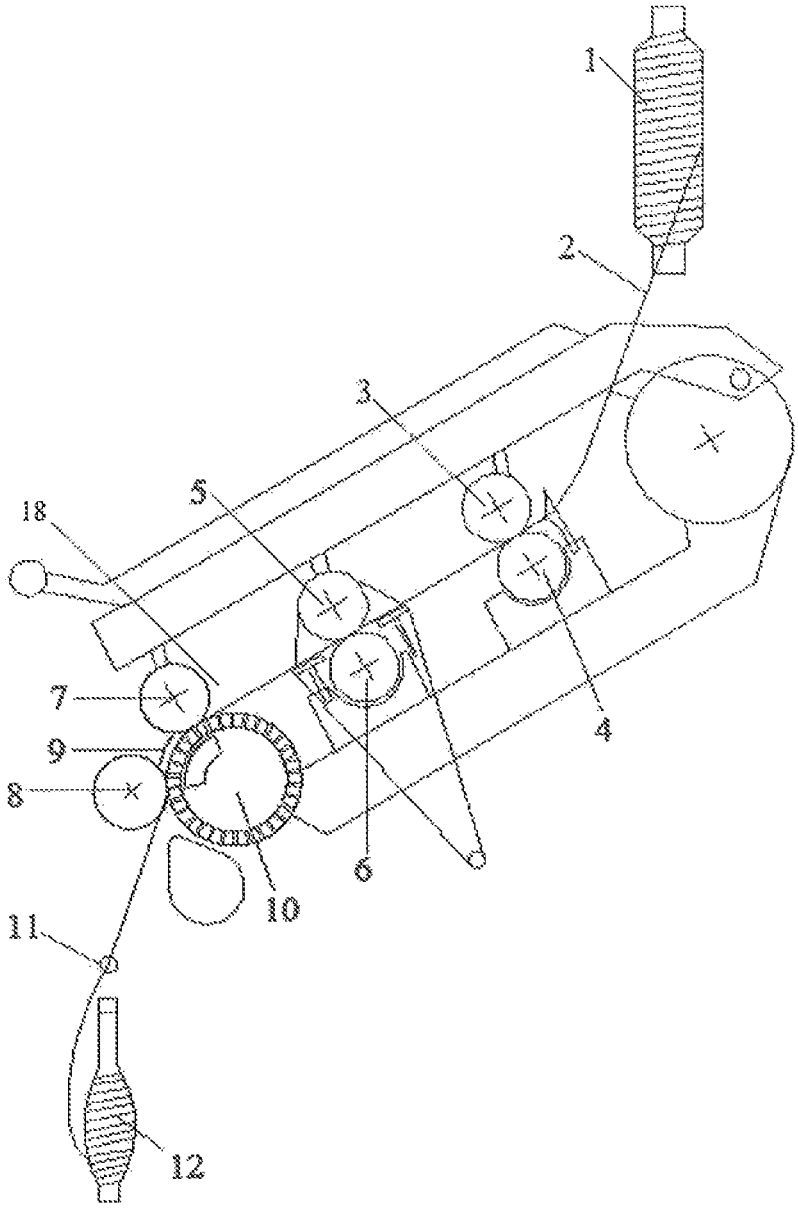
FIG. 1 shows the structure of the spinning device of an embodiment of the present invention.

The following further describes the invention in combination with the drawings and an embodiment. The present is not limited to the given embodiment.

Embodiment

As shown in FIG. 1 through FIG. 5, the spinning device for drafting single yarns in the embodiment comprises a drafting mechanism with several drafting pairs further comprising a front drafting pair at least; said drafting mechanism further comprises a cylindrical suction member (10); said front drafting pair consists of a front rubber roller (7), a block rubber roller (8), and a suction member (10), said front rubber roller (7) and the suction member (10) form the output holding jaw (16) and said block rubber roller (8) and the suction member (10) form the block jaw (17), an air guide member (9) located between the front rubber roller (7) and the block rubber roller (8) is installed above said suction member (10), a first suction channel is equipped in the side wall of said suction member (10), a second suction channel is equipped in said air guide member (9), and said front rubber roller (7), block rubber roller (8), air guide member (9), and suction member (10) jointly form a vortex twist zone (15) which fiber strands (18) can pass through.

Figure 2:
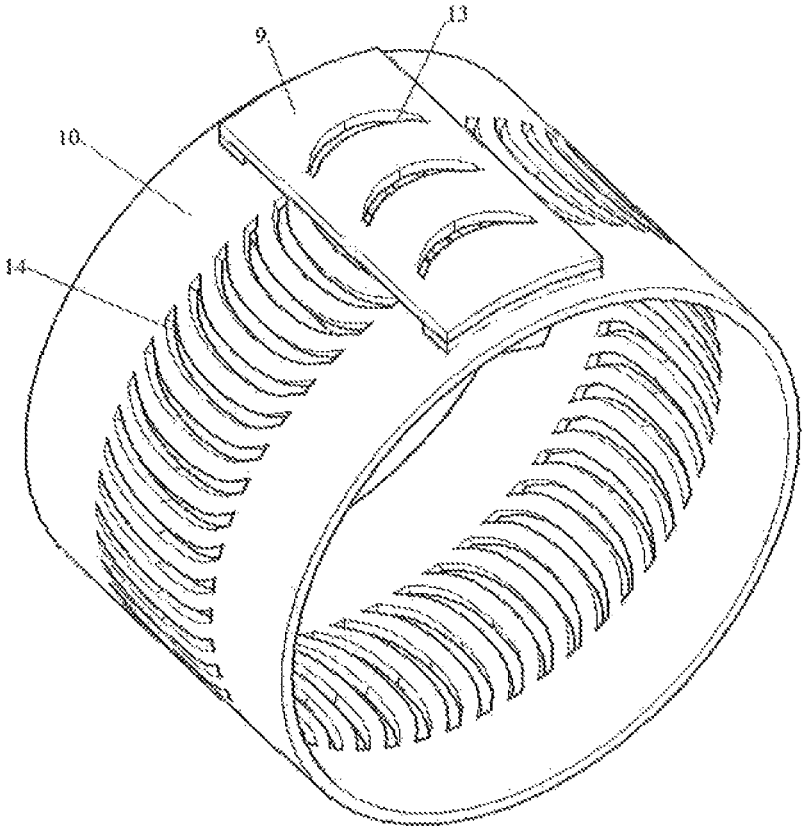
FIG. 2 and FIG. 3 show the mating between the suction member and the air guide member in the embodiment in FIG. 1.
Figure 3:
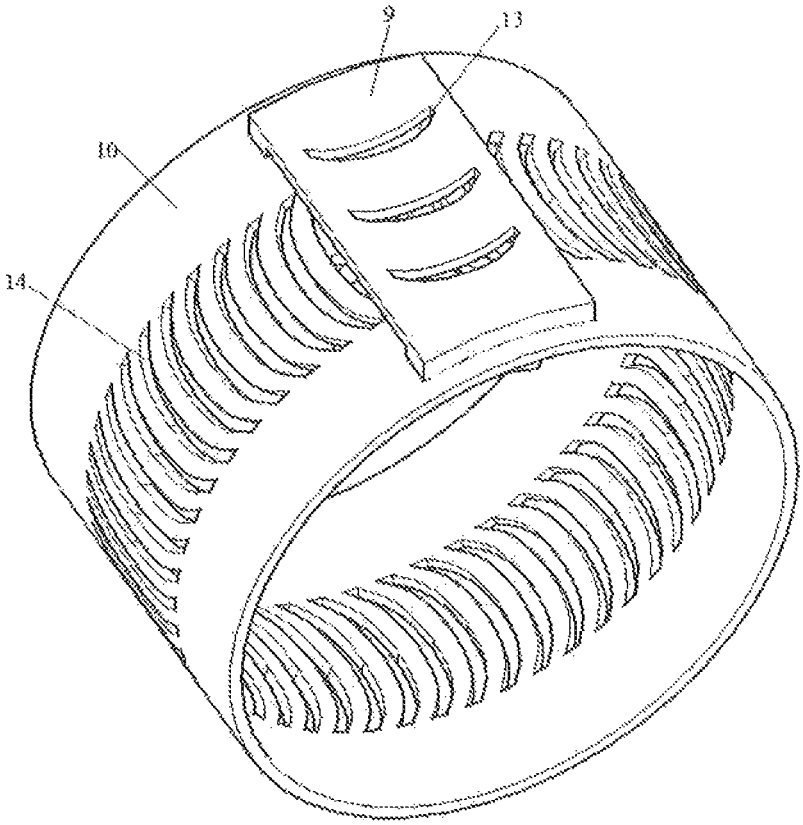
Figure 4:
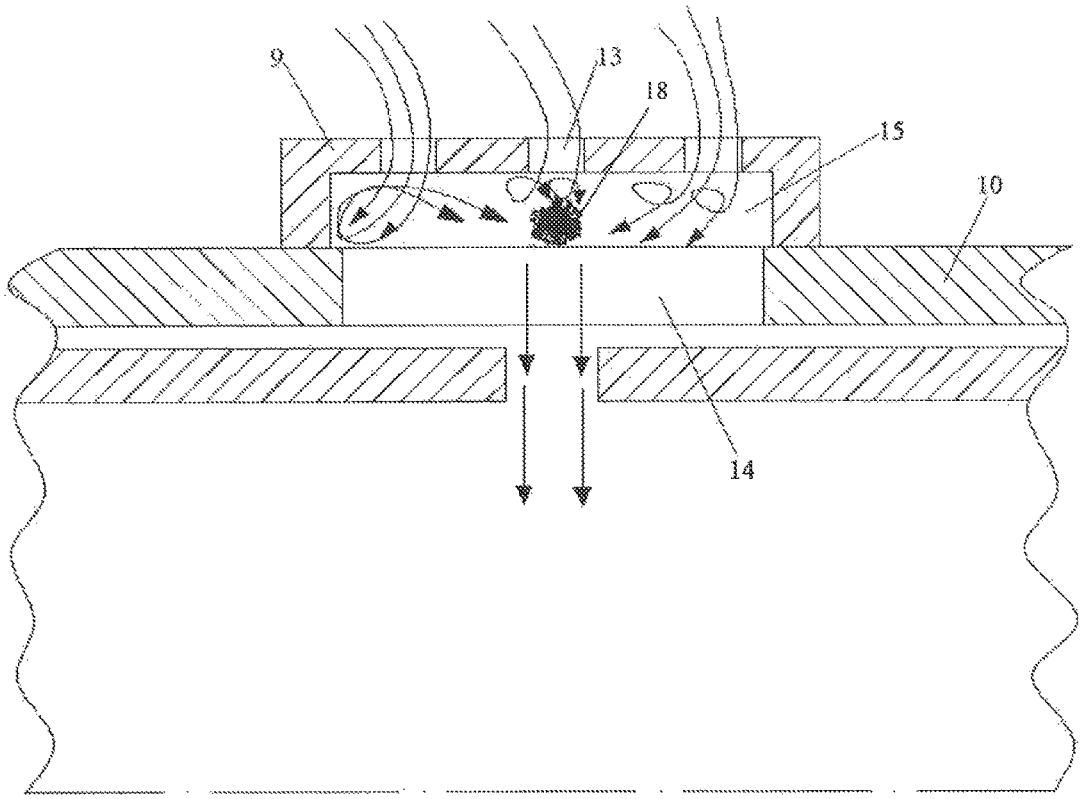
FIG. 4 shows the vortex twist zone in the embodiment in FIG. 1. The arrow in the figure is the air flow direction.
Figure 5:
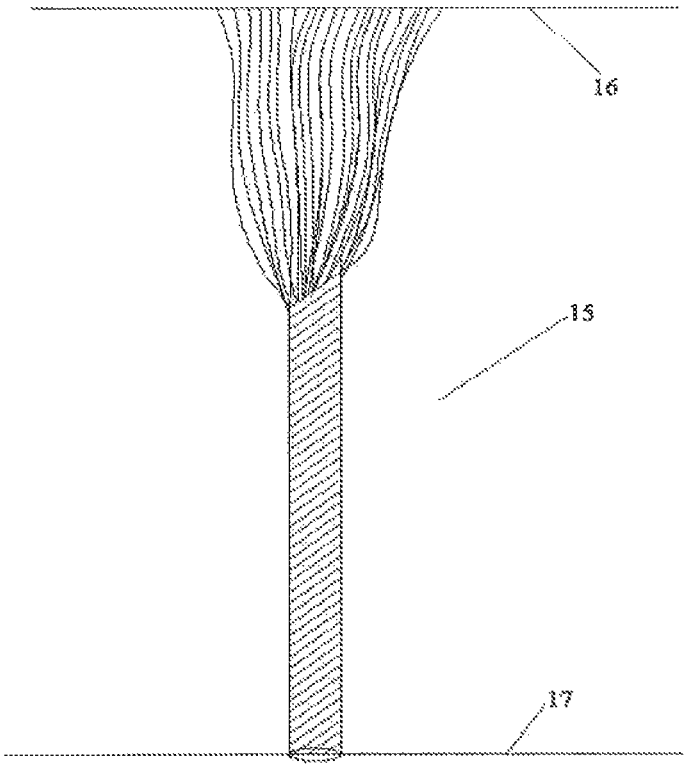
FIG. 5 shows the structural change of fiber strands in the vortex twist zone in the embodiment in FIG. 1.

As shown in FIG. 2 and FIG. 3, said first suction channel is a group of first arc grooves (14) which are parallel to each other and are bent along the circumference of the suction member (10), the hollow area of said suction member (10) is connected to an external air extractor (not shown in the figures), said second suction channel is a group of second arc grooves (13) which are parallel to each other and are bent along the axis of the suction member (10), and the bending directions of said first arc grooves (14) and second arc grooves (13) are vertical to each other. The bending directions of the second arc grooves (13) in FIG. 2 and FIG. 3 are opposite. The air guide member (9) has a substrate laid along the axis of the suction member (10) and the second arc grooves (13) are set in the substrate. The substrate of said air guide member (9) has a curvature to match the suction member (10).

The drafting pairs further comprise a middle drafting pair and a rear drafting pair, said middle drafting pair consists of a middle rubber roller (5) and a middle roller (6), and said rear drafting pair consists of a rear rubber roller (3) and a rear roller (4).

In addition, the spinning device in the embodiment further comprises a yarn guide hook (11) and a bobbin (12).

The method for drafting single yarns in the embodiment comprises the following steps:

step 1. feed fiber strands (2) with a twist through the roving bobbin (1) into the drafting mechanism to draft and obtain twistless fiber strands (18) at the output holding jaw (16) of the drafting mechanism, step 2. move said fiber strands (18) to the vortex twist zone (15) which draws in air from the outside to form an air eddy, which brings an overturn action to primarily twist fiber strands (18) so that fiber strands (18) have an original twist, along the axis of fiber strands, and integrate and compress fiber strands (18) on the suction member (10) under the suction action of the suction member (10) under the vortex twist zone (15) to form column fiber strands, The specific process is as follows: outside air first goes along the second arc grooves (13) of the air guide member (9) into the vortex twist zone (15) under the suction action of the external air extractor, then along the first arc grooves (14) of the suction member (10) into the hollow area of the suction member (10), and are finally extracted by the external air extractor so that an air eddy rotating round the axis of fiber strands (18) is formed in the vortex twist zone (15).

step 3. output said column fiber strands from the block jaw (17) of the drafting mechanism and twist them into spun yarns, wherein the diameter of column fiber strands obtained in step 2 is at most four times that of spun yarns obtained in step 3.

In the present embodiment, the suction member (10) provides the functions of drafting fiber strands and forming a vortex twist zone.

Besides the present embodiment, the present invention has other embodiments. All technical solutions formed by adopting equivalent replacement or transformation should fall within the scope of the claims of the present invention.

The invention claimed is:

1. A method for drafting spun yarn, comprising:

feeding twisted fiber strands into a drafting mechanism to draft and obtain twistless fiber strands at an output holding jaw of the drafting mechanism;

moving said twistless fiber strands output from the output holding jaw into a vortex twist zone disposed between the output holding jaw and a block jaw, the vortex twist zone drawing in air to form an air eddy causing a primary twist action upon the twistless fiber strands so that each of the twistless fiber strands obtain an axial twist along an axis of the twistless fiber strands to create axial-twisted fiber strands;

integrating and compressing the axial-twisted fiber strands via a suction action of a suction member forming part of the vortex twist zone to create column fiber strands; and twisting the column fiber strands output from the block jaw of the drafting mechanism to create spun yarn, wherein, an input diameter of the axial-twisted fiber strands is no greater than four times an output diameter of the spun yarn.

2. The method for drafting spun yarn according to claim 1, which is characterized in that said output holding jaw includes a front rubber roller and the suction member, said block jaw includes a block rubber roller and the suction member, an air guide member located between the front rubber roller and the block rubber roller is installed above said suction member, and said vortex twist zone is an area formed by the front rubber roller, block rubber roller, air guide member, and the suction member to allow the twistless fiber strands to pass through.

3. The method for drafting spun yarn according to claim 2, which is characterized in that said suction member is a cylindrical member equipped with a group of first arc grooves in a side wall, said group of first arc grooves are parallel to each other and are bent along a circumference of the suction member, said suction member having a hollow area of said suction member connected to an external air extractor, said air guide member having a substrate laid along an axis of the suction member, said substrate equipped with a group of parallel second arc grooves, said group of parallel second arc grooves being bent along the axis of the suction member, wherein said group of first arc grooves and said group of parallel second arc grooves are perpendicular to each other.

4. The method for drafting spun yarn according to claim 3, which is characterized in that said group of parallel second arc grooves along the axis of the suction member allow outside air to first go along the group of parallel second arc grooves of the air guide member into the vortex twist zone via suction action of the external air extractor, allowing outside air to then proceed along the group of first arc grooves of the suction member into the hollow area of the suction member, and be extracted by the external air extractor so that an air eddy rotating around an axis of the twistless fiber strands is formed in the vortex twist zone.

5. A spinning device for drafting spun yarn, comprising:

a drafting mechanism with drafting pairs including:

a front drafting pair including a front rubber roller, a block rubber roller, and a suction member, said front rubber roller and the suction member forming an output holding jaw and said block rubber roller and the suction member forming a block jaw, the front drafting pair further including an air guide member located between the front rubber roller and the block rubber roller installed above said suction member, said suction member including a side wall having a first suction channel equipped therein, said air guide member including a second suction channel equipped therein, and said front rubber roller, block rubber roller, air guide member, and suction member jointly forming a vortex twist zone to enable fiber strands to pass through.

6. The spinning device for drafting spun yarn according to claim 5, which is characterized in that said first suction channel is a group of first arc grooves which are parallel to each other and are bent along a circumference of the suction member, said suction member including a hollow area connected to an external air extractor, said second suction channel formed by a group of second arc grooves which are parallel to each other and are bent along an axis of the suction member, wherein said group of first arc grooves and said group of second arc grooves are perpendicular to each other.

7. The spinning device for drafting spun yarn according to claim 6, which is characterized in that said air guide member has a substrate laid along the axis of the suction member and said second arc grooves are set in the substrate.

8. The spinning device for drafting spun yarn according to claim 7, which is characterized in that the substrate of said air guide member has a curvature to match the suction member.

9. The spinning device for drafting spun yarn according to claim 6, which is characterized in that said drafting pairs further comprise a middle drafting pair and a rear drafting pair, said middle drafting pair including a middle rubber roller and a middle roller, and said rear drafting pair including a rear rubber roller and a rear roller.

* * * * *